US007416136B2

(12) United States Patent
Kübler

(10) Patent No.: US 7,416,136 B2
(45) Date of Patent: Aug. 26, 2008

(54) METHOD FOR PREPROCESSING SURFACE DATA, METHOD FOR QUALITY ASSESSMENT AND FOR QUALITY MANAGEMENT OF STRIP MATERIAL AND APPARATUS FOR CONTROLLING THE PROCESSING OF STRIP MATERIAL

(75) Inventor: Falk-D. Kübler, Hergiswil (CH)

(73) Assignee: Parsytec Computer GmbH, Aachen (DE)

( * ) Notice: Subject to any disclaimer, the term of this patent is extended or adjusted under 35 U.S.C. 154(b) by 166 days.

(21) Appl. No.: 11/515,521

(22) Filed: Sep. 5, 2006

(65) Prior Publication Data

US 2007/0084921 A1 Apr. 19, 2007

Related U.S. Application Data

(63) Continuation of application No. PCT/EP2005/002007, filed on Feb. 25, 2005.

(30) Foreign Application Priority Data

Mar. 4, 2004 (DE) ..... 10 2004 010 479
May 7, 2004 (DE) ..... 10 2004 022 607

(51) Int. Cl.
*G06K 19/06* (2006.01)

(52) U.S. Cl. ..... 235/493

(58) Field of Classification Search ..... 235/449, 235/493

See application file for complete search history.

(56) References Cited

U.S. PATENT DOCUMENTS 3,205,740 A 9/1965 Groves et al.
4,173,441 A 11/1979 Wolf
4,211,132 A 7/1980 Nichols, III et al.
4,542,527 A 9/1985 Tsunekawa
4,806,740 A * 2/1989 Gold et al. ..... 235/449
6,431,445 B1 * 8/2002 DeLand et al. ..... 235/449
6,828,968 B1 12/2004 Tenorio

FOREIGN PATENT DOCUMENTS

AT 006 236 U1 6/2003
DE 28 50 112 A1 5/1979
DE 694 25 684 T2 12/2000
DE 198 82 865 T1 1/2002

(Continued)

*Primary Examiner*—Jamara A Franklin
(74) *Attorney, Agent, or Firm*—Laurence A. Greenberg; Werner H. Stemer; Ralph E. Locher

(57) ABSTRACT

A method for preprocessing data for strip material, i.e. metal or paper strips, provides data records for a strip surface according to coordinates with information about a condition of the strip, its surface or anomalies. Some data records are grouped and stored in cells based on grouping rules. The cells are configured on a screen or other medium similarly to the strip surface. Contents of the cells can be electronically processed or linked to other cells or data and may be one-dimensional or contain and provide source data, grouping rules or processing formulae. The cells are in rows and columns of a spreadsheet. Preprocessing of the surface data allows statements about an achievable quality of an end product based on the material and the end product, even during production of the material, and simultaneous use of the surface data simply in production planning and quality management.

42 Claims, 5 Drawing Sheets

FOREIGN PATENT DOCUMENTS

| | | | |
|---|---|---|---|
| DE | 102 46 002 | A1 | 5/2003 |
| DE | 102 07 534 | A1 | 9/2003 |
| EP | 0 094 824 | B1 | 12/1988 |
| EP | 0 615 200 | B1 | 9/1994 |
| EP | 1 341 112 | A2 | 9/2003 |
| WO | 99/41652 | | 8/1999 |

* cited by examiner

METHOD FOR PREPROCESSING SURFACE DATA, METHOD FOR QUALITY ASSESSMENT AND FOR QUALITY MANAGEMENT OF STRIP MATERIAL AND APPARATUS FOR CONTROLLING THE PROCESSING OF STRIP MATERIAL

CROSS-REFERENCE TO RELATED APPLICATIONS

This is a continuing application, under 35 U.S.C. §120, of copending International Application No. PCT/EP2005/002007, filed Feb. 25, 2005, which designated the United States; this application also claims the priority, under 35 U.S.C. §119, of German Patent Applications DE 10 2004 010 479.4, filed Mar. 4, 2004 and DE 10 2004 022 607.5, filed May 7, 2004; the prior applications are herewith incorporated by reference in their entirety.

BACKGROUND OF THE INVENTION

Field of the Invention

The present invention relates to a method for preprocessing data which is related to coordinates of a surface, and is referred to in the following text as surface data. The present invention also relates to a method for quality assessment of strip material, a method for quality management of strip materials and an apparatus for controlling the processing of strip materials.

Automatic systems for surface inspection are often used when materials in the form of a strip are produced in a quickly flowing form. In particular, those are metals, for example steel, as well as paper, which in some cases are manufactured at speeds of more than 30 m/s in the case of paper, and of more than 20 m/s in the case of steel. Those strip materials are generally processed further by winding them up to form coils, or are transported to a customer who uses the strip material to manufacture end products. In that case, completely different end products can be produced from substantially identical coils, for example on one hand washing-machine parts and on the other hand car parts from similar steel coils. However, it is not possible to use any coil for any end product or intermediate product since the customers for the coils are subject to requirements relating not only to the composition of the material but often also to quality standards, which the condition, in particular the surface, of the strip material must satisfy in order to allow them to be used for a specific end product. So-called "coil grading", that is to say the quality assessment of a strip material, is of critical importance to the value of a coil and for its further processing.

In order to ensure that a specific quality standard is satisfied, the condition and/or the surface of the strip material must be checked, in particular for anomalies, to be precise before being wound up to form coils. Surface inspection is normally carried out by specifically trained personnel who either check the surface itself (by observing it continuously) or use an automatic system for surface inspection. Systems such as those monitor the surface of the strip material using cameras, for example, with different monitoring principles being known. In addition, other data which does not necessarily describe anomalies, for example the thickness of the material, the surface roughness, the temperature profile of a heat treatment etc, can be determined using various measurement methods, and can be associated with the individual surface points.

By way of example, International Application No. WO 01/23869 A1, corresponding to Australian Patent Application AU 7658100A, discloses surfaces being observed using the so-called bright-field or dark-field method. International Application No. WO 01/23869 A1, corresponding to Australian Patent Application AU 7658100A, also discloses the results of the two inspections being correlated with one another in order to allow better fault identification to be carried out in that way. Further surface analysis systems and measurement methods for recording material data are likewise known from the prior art.

All of those systems have the advantage that considerably more data is gathered and considerably more surface anomalies are detected than in the case of "visual" inspection by an inspector. By way of example, 2 to 5 anomalies per coil are generally found during visual inspection of an average coil, with more than 20 anomalies only in exceptional cases. The number of registered anomalies when using automatic surface inspection systems for a comparable coil is regularly greater by a factor of more than 100. On one hand that is, of course, advantageous because considerably more anomalies can be detected, but on the other hand it presents the operator with hurdles that are virtually impossible to overcome: Due to the large number of registered anomalies (on average hundreds to several thousand per coil), it is virtually no longer possible for the observer to decide on the basis of the large amount of data which registered anomalies are or are not relevant for achieving a specific quality standard for the end product to be produced from the strip material. By way of example, it is possible for only 3 of 2000 registered anomalies to actually be of importance for the quality standard to be achieved. However, the observer frequently has to decide very quickly what quality standard can be complied with and what cannot, since that is normally done during the production of the strip material, that is to say before the wound-up coil is separated from the strip material.

Until now, corresponding automatic evaluation of the bulk data has been carried out only in exceptional cases, through the use of specific programming. Furthermore, although the data obtained by automatic surface inspection was in principle available for further processes, for example for financial control purposes or for automatic creation of quality certificates, it has de facto not been possible to process the data further in a worthwhile manner because of the incredibly large amount of data involved. Typical data processing systems cannot be used directly for data which, as in this case, relates to the coordinates of a surface, that is to say data having a geometric reference.

SUMMARY OF THE INVENTION

It is accordingly an object of the invention to provide a method for preprocessing surface data for the assessment of strip material, which allows analysis of the available surface data on the basis of freely predeterminable criteria and allows further processing of the data in a simple manner, a corresponding method for quality assessment and for quality management of strip material and a corresponding apparatus for controlling the processing of strip material, which overcome the hereinafore-mentioned disadvantages of the heretofore-known methods and apparatuses of this general type.

With the foregoing and other objects in view there is provided, in accordance with the invention, a method for preprocessing data for a strip material, in particular for metal and/or paper strips. The method comprises providing the data in the form of data records to be associated with a strip surface according to coordinates and to include information about a condition of the strip and/or the strip surface and/or a possibly present anomaly. At least some of the data records are grouped and stored in cells on the basis of predeterminable grouping rules. The cells are geometrically configured on a screen or another visualization medium having a topological similarity to the strip surface. Contents of the cells are made available for further electronic processing and/or linking to other cells or other data. In this case, in particular, the contents of one cell need not be merely one-dimensional but may contain and make available source data, grouping rules and/or processing formulae.

Although cells, once they have been grouped and once their contents have been defined, allow automation of subsequent quality assessments, the accessibility and variability of the cells and cell contents mean that they are in fact not of much use in practice. In this case, a topological similarity between the strip surface and the presentation of the data to a user assists in intuitive action when changes are intended to be made to the cell contents and their links. In this case, topological similarity need not mean that the entire strip surface is imaged using the same scale, but may relate to a distorted representation of the entire surface, or of a part of the surface. The important factor in this case is that the part which is currently being imaged corresponds approximately to the constellation of the surface points or surface areas being considered on the strip surface.

In accordance with another mode of the invention, it is particularly preferable to display those cells, in particular on a screen, in the form of at least one spreadsheet having a plurality of cells disposed in rows and columns. Spreadsheets are widely used for displaying and processing data, and can be used without any programming knowledge.

An anomaly is understood to be a discrepancy in the surface from a desired nominal state. In the case of steel strips, for example, this may be a roller impression or an oil spot. In the case of paper strips, it may be, for example, a discolored area or a thickened area, in this case. In the case of paper webs, further information can also be obtained, for example by through-lighting, which provides additional information about material anomalies.

The provision of surface data in the form of a spreadsheet allows the surface data to be grouped and processed further in a particularly advantageous, flexible and simple manner. In particular, this offers the advantage that even users who fundamentally have little experience with the programming of computers can nevertheless define grouping rules in the form of formulae in a simple manner, as is known from traditional spreadsheets, such as Microsoft Excel or the like. On one hand, this allows the group of people who prepare for and/or carry out a surface inspection to be widened, while on the other hand the surface data which has been obtained by automatic measurement and analysis systems is for the first time available in a practicable manner for further processing by wide user groups.

By way of example, the surface data can be grouped in such a manner that the data records are grouped spatially, and can be spatially associated with a subsequent end product. For example, in the case of a steel strip from which, if required, engine compartment hoods can be manufactured for a car, a group rule can be used in which the surface data which is combined is that which corresponds to that part of the surface of a steel strip which will subsequently form the surface of the engine compartment hood. This group of surface data then includes all of the anomalies which have been found in this spatial area during the surface inspection of the strip material.

Figuratively speaking, the grouping rules can be used to create a type of map on the strip material, which images the position and orientation on the strip material of the end products which will subsequently be produced from that strip material. The user of the surface inspection system is therefore provided with a tool which allows him or her to focus his or her attention on those areas of the strip material which will be relevant for the subsequent end product. Areas which are not relevant for the end product, for example edge areas of the strip material which are generally cut off and thrown away, can thus be rejected even before making the decision as to whether or not a specific quality standard can be achieved. Faults in these areas can in this case be ignored in the decision-making process even if they are very numerous and serious. The method according to the invention therefore makes it possible to reduce the amount of data for evaluation of surface inspection data, to simplify and speed up the process of making decisions relating to the assignment of quality standards, and to make this assignment process more reliable and reproducible. In addition, automatic decision-making is also actually made considerably simpler and more reliable, once the necessary groupings and processing operations relating to the cell contents have been defined. Adaptation to match new conditions or knowledge is possible in a simple manner at any time. It should be noted that, for the purposes of this invention, an end product represents an end product relative to the strip material, that is to say an end product for the purposes of this invention may also be an intermediate product which will be subject to further processing steps.

Furthermore, once a decision has been made on the basis of the surface data that a specific quality standard cannot be met, the system makes it possible to check in a simple manner whether or not other quality standards can be met. By way of example, this is done simply by using a different grouping rule. In the above example, following the decision that the steel strip does not meet the quality standard for an engine compartment hood, it will be possible, for example, to use the appropriate grouping rule to check whether or not a quality standard for a different end product to be manufactured from the strip material can be met. By way of example, this makes it possible to check whether or not the steel strip is suitable for the manufacture of fenders.

Furthermore, the data which has been processed in this way can be made available in a simple form to third parties. In the above example, for instance, the data can be made available to a customer or to someone processing the steel strips. This person can thus on one hand check the quality level assignment by the steel manufacturer or can use his or her own grouping rules autonomously in order to check whether or not the steel strip can be used for a different end product, with little scrap.

The creation of grouping rules and further processing of the data can be carried out in a simple manner by the programming for formulae in individual cells in a spreadsheet, as is known from conventional spreadsheets. Using a simple example, grouping can mean that, for example, the sum of the faults is formed in an area which can be associated with specific spatial coordinates, such as an end product. Formulae such as these can also be used for comparison with quality standards to be complied with. By way of example, a formula "if the group includes less than two faults of the Type X and the surface roughness is below a value Y" could lead to a specific quality standard being assigned only when all of the relevant groups, or a predeterminable proportion of the relative groups, satisfy this formula. It is also possible to carry out a summary comparison of all of the anomalies in the groups, using predetermined limit values.

It is also possible, in the case of a strip, to preprocess and to store both the surface data relating to one face of the strip material (the front face) and that relating to the other face (the rear face) of the strip. With an appropriate distribution of anomalies on one face and on the other face, this makes it possible to change from the front face to the rear face, and this can advantageously lead to a reduction in the scrap.

According to one advantageous refinement of the method according to the invention, the surface data includes surface roughness, planarity, a finishing temperature and/or a thickness of the strip material.

The surface roughness and surface planarity are of critical importance in the further processing of end products, especially for the production of steel strips. A finishing temperature should be understood as meaning, for example, an annealing temperature in the case of steel strips, which influences the brittleness of the steel. Heat-treatment temperatures such as these can have a critical influence on the subsequent further-processing of the material, and consequently also on the allocation to quality standards. The same applies to the thickness of the strip material, in particular if the thickness is not uniform. This advantageously allows inhomogeneities in these parameters to be taken into account. According to the invention, the surface data can also include further data relating to the condition of the strip and/or the surface.

According to a further advantageous refinement of the method according to the invention, a data record for a surface anomaly includes at least one anomaly type, an anomaly size and/or an anomaly severity.

An anomaly type should be understood as meaning a classification, as is in each case normal in this field, of the surface anomaly of the strip material, for example rust, an impression, a scratch, scale stippling, a bubble, etc. for steel. The anomaly size may be either relative (smaller than the physical extent of the group, larger than the physical extent of the group) or else absolute (for example two square centimeters). The anomaly severity is understood as meaning the amplitude of the discrepancy from the desired nominal state of the surface, for example in the case of scaling, the extent of blackening or the like. The anomaly severity thus represents a measure of the discrepancy from the desired nominal state of the surface.

According to one further advantageous refinement of the method according to the invention, the grouping rules are used to carry out at least one of the following grouping operations:

a) combination of data records which correspond to physically adjacent and/or correlated surface anomalies;
b) combination of data records which can be physically associated with predeterminable areas of the strip material;
c) combination of data records which correspond to identical surface anomalies;
d) combination of data records which include surface anomalies which on their own or together with other surface anomalies and/or with other data, in particular relating to the surface roughness or planarity, allow the assignment of a quality level in comparison to at least one quality standard, in particular that of the end product to be manufactured from the strip material; or
e) combination of data records which correspond to surface anomalies with an anomaly severity, and which are within a predeterminable value range of the anomaly severity.

For the purposes of a grouping operation on the basis of a), correlation means any type of mathematical correlation, that is to say any type of mathematical operation in which a relationship is produced between two variables.

Grouping of data records on the basis of a) allows physically adjacent anomalies to be grouped. For example, this makes it possible to identify production faults during the manufacture of the strip material, as a result of which adjacent surface anomalies or correlated surface faults (such as periodic surface faults) occur. For example, these may be scratches which are continuous in the movement direction of the strip, or periodic impressions from the rolling tools.

The grouping of data records based on b) allows, for example, the combination of surface anomalies in areas which generally represent scrap because of the production process for the strip material and/or the end product, for example edge areas or end areas of the strip. A further example is the capability described above to combine areas on the strip surface which are associated with the end product to be manufactured.

Grouping of data records on the basis of c) makes it possible to combine substantially identical or similar surface anomalies.

Grouping on the basis of d) makes it possible to combine data records which are relevant to compliance with or else overcompliance with a specific quality standard. In this case, the quality level refers to a quality indication which is generally associated with the strip material, while the quality standards represent standards which are independent of this strip material, for example standards set by the customers. For example, a quality standard I can represent that quality which the surface of a steel sheet must have in order to allow it to be used to manufacture engine compartment hoods. A quality standard II could represent that quality which the surface of a steel sheet must have in order to allow it to be used to manufacture washing-machine parts. The quality level of one very specific sheet may, for example, then be defined sufficiently simply that it is not adequate to meet the quality standard I, even though it is sufficient to meet the quality standard II. This advantageously allows accurate assignment of strip materials to the end products to be produced later, both at the premises of the manufacturer of the strip material, and at the premises of the customer and processor of these strip materials, who can then assign the optimum use to each strip or coil in their business, in particular minimizing the amount of scrap incurred, or can also reject them.

The grouping based on d) may represent not only a purely physical grouping to match the end product to be produced, but also a correlation of surface anomaly data with further parameters such as the surface roughness or the like. However, a grouping based on d) is not restricted to these examples, and in fact a grouping process can be carried out matched to the currently required quality standards in any desired possible manner.

By way of example, a grouping operation based on e) makes it possible to estimate faults in the production process of the strip material, in which surface anomalies of a specific anomaly severity are grouped in the form of a map with contour lines.

According to one further advantageous refinement of the method according to the invention, during a grouping operation based on b) and/or based on c), areas of the strip material are taken into account which can be assigned to at least one subarea of the end product to be manufactured from the strip material.

As described above, this makes it possible to form a type of map of the surface which in its own right includes the position, orientation and size of the end products to be manufactured from the strip material.

According to a further advantageous refinement of the method according to the invention, during a grouping operation based on b), the geometric condition of the strip material is imaged, in particular with respect to scrap areas which are governed by the production process of the strip material.

This advantageously makes it possible to ignore faults in areas which are not located in the end products to be manufactured, as far as the assignment of the quality level is concerned, thus reducing the amount of data to be considered.

According to one further advantageous refinement of the method according to the invention, the individual cells of the spreadsheet can be matched, at least with respect to position, orientation and size, to the geometric condition of the strip material, and/or to the position, orientation and/or physical extent of the anomalies, and/or to the groups on the strip surface.

By way of example, this function allows the strip material to be imaged substantially true to scale in the spreadsheet, with the size relationships between the groups on the strip material corresponding substantially to the size relationships between the individual cells.

According to a further advantageous refinement of the method according to the invention, the individual cells can be matched with respect to at least one of the following variables:

A) color of the background;

B) color of the cell content;

C) shading of the cell;

D) font of the cell content;

E) script emphasis of the cell content; or

F) script pitch of the cell content, such that these variables A) to F) represent the relevance for the assignment of the quality level of the end product to be manufactured from the strip material.

This means that, in addition to any desired representation of the group in the cell, for example a sum of the number of surface anomalies in this cell, further dimensions (color, shading, font, etc.) are in practice opened up for the representation of the relevance of the surface data in this cell for the assignment of the quality level. By way of example, cells which contain groups which prevent compliance with a predetermined quality standard can thus be marked with a red background and script emphasis, or the like, without having to open a further cell. The relevance of this data is evident in a very simple manner to the user. Script emphasis in this context means in particular the representation of the cell content using bold, italic, underlined and/or struck-through script, as well as upper-case script and/or spaced-out script.

According to a further advantageous refinement of the method according to the invention, the quality level is assigned relative to predeterminable quality criteria.

Based on the above example, this means that the quality level states that a quality standard I is not met, but that a quality standard II is met. The quality level may in a simple manner be in the form of a list of all of the quality standards which are met.

According to a further advantageous refinement of the method according to the invention, the quality level is assigned on an absolute basis.

One simple case of an absolute assignment of the quality level is, for example, to state the number of anomalies that have occurred, possibly weighted with the anomaly severity and/or the area of the occurrence on the surface of the strip material.

According to a further advantageous refinement of the method according to the invention, the assignment is based on a formula in the spreadsheet.

By way of example, the formula may include an instruction which states "assign quality level I if the number of anomalies of Type X is less than Y and if the heat-treatment temperature in all groups is greater than Z". Other formulae as are normal in conventional spreadsheets are possible and are covered by the invention.

According to a further advantageous refinement of the method according to the invention, at least one data record or at least one group is represented at least partially in one cell of a spreadsheet.

This makes it possible to represent at least one data record or at least one group, in each case at least in parts, in one cell. In each case in parts means that only parts of the data record or of the group are represented, in which case, in particular, the user can choose what he or she would like to have displayed from each data record. By way of example, from each group, it is possible to display the number of surface anomalies registered in this group, the average heat-treatment temperature, the average strip thickness and/or the average surface roughness, etc., of the group or of the data record, in each case in individual cells or jointly. It is also possible to display only the number of anomalies of one specific anomaly type in the group or in the data record, and this is covered by the invention. In this case as well, a display or else corresponding filtering are also possible in the form of a conventional spreadsheet. By way of example, the respective coordinates on the strip material or else any another desired details, which can be adapted by the user, can be used in the column and/or row headings.

According to a further advantageous refinement of the method according to the invention, a plurality of spreadsheets are formed with different representations of the surface data.

This makes it possible to use different tables (that is to say one sheet of a spreadsheet) for respectively matched filtering of the data. By way of example, it is possible to state the numbers of anomalies per group or data record in each cell, as a function of their position on the surfaces of the strip, in one table in each case. Individual data records can be listed per row in another table, so that each individual data record can be accessed, without major effort, etc.

According to a further advantageous refinement of the method according to the invention, the spreadsheets can be linked to one another.

By way of example, it is thus possible to program a link, for example in the form of a hyperlink in the Internet, between different tables, so that, by way of example, one cell with a group of data records can be linked to that point in a list of all of the individual data records which corresponds to the first data record in the group, or to the first data record in the group with a surface anomaly. Any desired links between the tables are possible and are covered by the invention.

According to a further advantageous refinement of the method according to the invention, it is possible to predetermine which elements of the data in a group or in a data record can be represented in a spreadsheet.

The amounts of data to be represented can thus be considerably reduced if, by way of example, data which, although present (for example the finishing temperature), is, however, irrelevant for the end product to be manufactured from the strip material, is not represented. In this case, in particular, it should be possible to make the data which is not displayed visible at any time, by the memory structure which is associated with the cells containing the entire database and the links that have been introduced.

According to a further advantageous refinement of the method according to the invention, it is possible to predetermine the breakdown in which the data in a group or in a data record can be represented.

In this case, breakdown should be understood as meaning the configuration and the splitting of the spreadsheet, that is to say by way of example the definition of which column will be used to display what element of the data records and/or of the groups, and what will be represented in each row, etc. It is thus possible to configure one or more spreadsheets which each represent data in a form which corresponds to a specific problem. This can be adapted individually by any user in precisely the same way as is possible in conventional spreadsheet calculations.

According to a further advantageous refinement of the method according to the invention, individual cells can be linked to representations which the data of the group which is linked to this cell or of a data record which is linked to this cell at least partially shows, in particular at least to a graphical representation of a corresponding surface anomaly.

For example, this means that it is possible to provide a type of magnification function, through the use of which all of the available data is displayed, if the display does not cover all of the data in a data record or a group.

According to a further advantageous refinement of the method according to the invention, at least some of the surface data is obtained from the signals from at least one measured-value recorder, preferably a camera, and particularly preferably a CCD camera or CMOS camera.

In particular, the use of CCD cameras with high time and spatial resolution is advantageous for the surface checking of strip materials moving at high speed.

With the objects of the invention in view there is also provided a method for quality assessment of a surface of moving strip materials, in particular metal or paper strips. The method comprises preprocessing surface data on the basis of the method according to the invention for preprocessing of surface data, and assigning a quality level to the strip material based on the preprocessed surface data.

This method according to the invention makes it possible on one hand to allocate a quality level to the strip material in a simple manner even during manufacture or only prior to further processing of the strip material, on the basis of the preprocessed data as described above, with this quality level preferably being oriented to predeterminable quality standards. Reference is made to the details and advantages, as stated above, of the method according to the invention for preprocessing of surface data for a strip material. The invention also makes it possible for a customer of strip material to group and to evaluate the available data on the basis of widely differing viewpoints, until he or she has found a way of combining the data that is relevant for his or her requirements. During this process, he or she can carry out adaptation processes and improvements repeatedly. The relevant type of combination that is found can then in each case be used in an automated manner, without repeated assessment by an inspector, for assessment of further coils, and/or can be passed to the manufacturer of the strip material in order to obtain the desired quality there, even in an automated form, during manufacture, or to sort out coils which do not meet this quality.

With the objects of the invention in view there is furthermore provided a method for quality management of strip materials. The method comprises assigning a quality level to the strip material on the basis of the method according to the invention for quality assessment, and supplying the strip material, on the basis of the assigned quality level, to-a processing step requiring a specific quality level.

With the objects of the invention in view there is additionally provided a method for quality management of strip materials, in particular metal or paper strips. The method comprises preprocessing the surface data with the method according to the invention, and configuring a production process and/or a process used for processing the strip material on the basis of the preprocessed surface data, to produce as little waste as possible during manufacture of an end product from the strip material.

The expression quality management should be understood as meaning a complex, multidimensional process, in this case. This not only covers the assignment of a quality level to a specific strip material (coil) even though this represents the basis of the rest of the quality management process. In fact, this term should be understood as meaning an iterative matching process over a plurality of strips, taking into account a plurality of possible end products, possibly also from a plurality of possible end products from different manufacturers in different fields, in each case taking into account the respective field-specific and manufacturer-specific quality requirements and standards. A quality management process such as this can be carried out effectively for the first time by using the method according to the invention for preprocessing of surface data. On one hand, this quality management process can be carried out at the premises of the manufacturer of the strip material, by maintaining a list with the job orders, including the respective quality standards to be met and the size of and requirements for the end product to be manufactured, with multidimensional adaptation being carried out on the basis of the strip material under consideration. In this case, the scrap is minimized while at the same time maximizing the quality standard that can be achieved, for example maximizing the possible price to be achieved. In this case, in particular parameters "outside" the strip material, that is to say a different grouping depending on the end product to be manufactured, as well as parameters "within" a strip material, that is to say by way of example a shift in the grouping in the longitudinal direction, that is to say in the movement direction of the strip material and/or transversely with respect to it, can be used as variation parameters. In this case, it is not only possible to shift all of the associated groups, but also to shift individual groups, so that, by way of example, instead of the shortest possible distance between two adjacent end products to be manufactured, an additional distance is introduced on the strip material, which admittedly at first glance increases the scrap, specifically by this additional piece, but overall reduces the scrap because it is possible to manufacture more end products which meet the necessary quality standard. A further optimization dimension results from a plurality of parallel strip production lines, in which case optimization is in each case carried out for a plurality of strip materials being manufactured at the same time. This optimization can also be carried out within a spreadsheet. A corresponding quality management process can also be carried out at the premises of the processor of the strip materials. In this case, it is also possible to reject the coils, as a further result of the quality management process. The advantages and details disclosed above apply in the same way to the method according to the invention for quality management.

With the objects of the invention in view there is provided, as well, an apparatus for controlling the processing of strip materials, in particular metal or paper strips. The apparatus comprises an evaluation unit including at least:

a) a storage device for storing at least one of surface data to be associated with a strip surface according to coordinates or quality standard data to be associated with an end product to be manufactured;

b) a grouping device for grouping said surface data on the basis of predeterminable grouping rules, with a group including at least one data record of said surface data; and c) a comparison device for comparing groups of said surface data with at least one predeterminable quality standard and supplying comparison data.

Data links are connected to said evaluation unit. An input device and an output device are connected to said evaluation unit through said data links, for inputting commands and at least outputting said surface data from said evaluation unit. A control device is connected through said data links at least to said evaluation unit and to said input device and/or said output device. The input device and said output device interact to display and process said surface data, to input said grouping rules and/or comparison rules in a corresponding manner, and to compare said groups with at least one quality standard in the form of at least one spreadsheet. The control device initiates a specific process for processing the strip material to manufacture an end product or rejects the strip material, on the basis of said comparison data supplied by said comparison device and/or a user input.

When the invention is used on-line, the control device is preferably connected to a marking device, in particular for coloring, stamping or perforation of a strip material on the basis of predeterminable criteria and/or at parts with particular anomalies. The invention can thus be used in a flexible manner for identification purposes during the production process or at its end, with the identification criteria being easily variable by appropriate processing of the cells in a spreadsheet.

In this case, the apparatus is at least suitable for carrying out at least one of the methods according to the invention. According to one advantageous refinement of the apparatus according to the invention, this apparatus has at least one measured-value recorder, preferably a camera, and particularly preferably a CCD or CMOS camera, which records surface data, with the measured-value recorder being connected to the evaluation unit through data links, and transmitting the surface data to the evaluation unit.

According to a concomitant refinement of the apparatus according to the invention, the evaluation device is constructed to use the surface data to detect surface anomalies on the surface of the strip material.

The details relating to the method according to the invention as disclosed above can be applied directly to the corresponding apparatus through the use of appropriate measures which carry out the method steps, and can be transferred directly. The features, their advantages and details will therefore not be repeated, even though they are likewise applicable to the apparatus.

Other features which are considered as characteristic for the invention are set forth in the appended claims.

Although the invention is illustrated and described herein as embodied in a method for preprocessing surface data, a method for quality assessment and for quality management of strip material and an apparatus for controlling the processing of strip material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
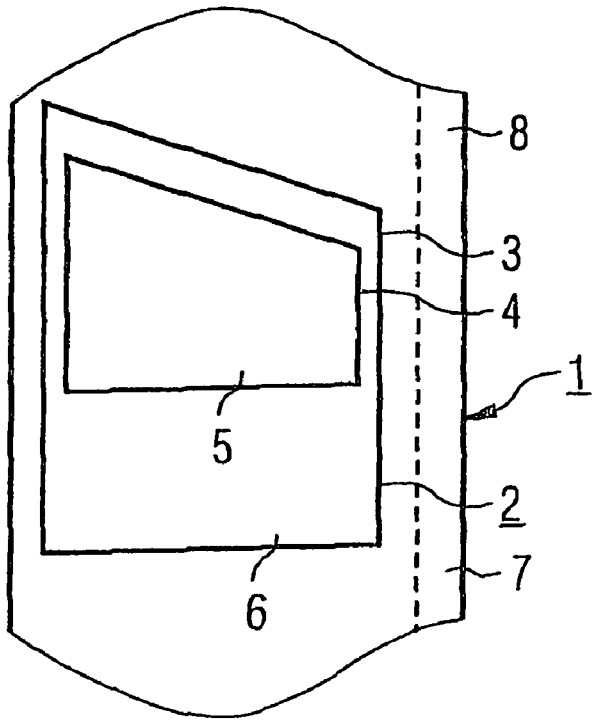
FIG. 1 is a fragmentary, diagrammatic, plan view of a strip material.

Referring now to the figures of the drawings in detail and first, particularly, to FIG. 1 thereof, there is seen a diagrammatic representation of a portion of a strip material 1, for example a portion of a steel strip 1. The intention is to manufacture car doors 2 from this steel strip 1. An outline of a car door 2 that is to be manufactured is indicated, by way of example, on the steel strip 1, and represents an area of the steel strip 1 which is assigned to the car door 2 to be manufactured. In other words, with regard to the steel strip 1, during the production of the strip or before production of the car door 2, this is initially purely a virtual assignment in which, in particular, there is no physical marking on the steep strip 1. The car door 2 has a door area 3 and a window area 4.

An automatic surface inspection of the steel strip 1 is carried out, with the result thereof being data records which can be associated with coordinates of the surface of the steel strip 1. Each data record thus represents the surface condition of a surface unit at a position which is defined by the corresponding coordinates on the strip surface. In particular, the data records include data relating to surface anomalies, that is to say discrepancies between an actual state of the surface of the steel strip 1 and a desired nominal state of the surface.

During the assessment of the surface of the steel strip 1 and, in particular, also for the definition of a quality level of the material, surface anomalies that occur have different importance depending on the coordinates where they occur. For example, if a first surface anomaly 5 occurs in the window area 4, then this is of lesser importance for the assignment of a quality level for the manufacture of car doors 2 from the steel strip 1 than the occurrence of a second surface anomaly 6 in the door area 3. A third surface anomaly 7 which occurs in an edge area 8 of the steel strip 1 is likewise of relatively minor importance. However, in conventional surface inspection systems, no reference would be made to the (virtual) configuration of the car doors 2 to be manufactured from the steel strip 1, so that both surface anomalies 5, 6 would be used with equal weightings to define the quality level. When taking the overall length of the strip, which may be several hundred to one thousand meters, into account, this leads to a large amount of data which exacerbates reliable and reproducible assignment of a quality level, or makes it virtually impossible.

According to the invention, this problem is solved by grouping the data records on the basis of predeterminable grouping rules. In the present example, one grouping of the data records can form the door area 3, and a further grouping of the data records can form the window area 4. In this case, those data records which form the door area 3 can be combined in a single group, although it is also possible to form a plurality of groups, each of which form approximately rectangular subareas of the door area 3.

Figure 2:
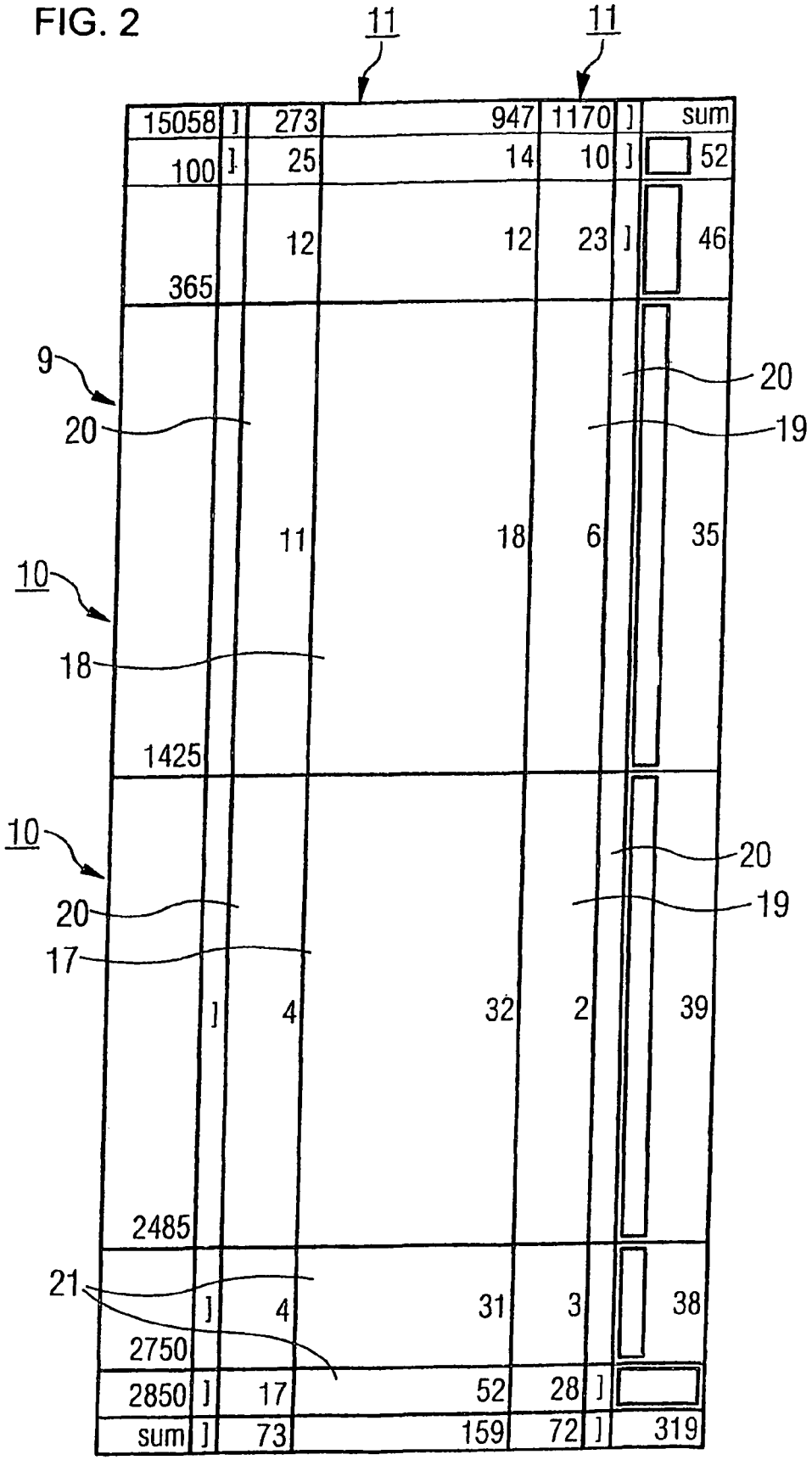
FIG. 2 is a plan view of a spreadsheet.

The data which has been grouped in this way is produced within at least one spreadsheet. FIG. 2 shows an example of one such spreadsheet.

FIG. 2 shows a detail of a spreadsheet 9, which is subdivided in the normal manner into cells 12 that form rows 10 and columns 11, which are illustrated only in an exemplary manner for clarity. The example provided in FIG. 2 shows surface data for a steel strip 1 which has been split into a plurality of groups. In the present case, each cell 12 includes one group of surface data. The size, position and orientation of the cells corresponds to the position, orientation and extent of the corresponding groups of surface data, as is evident from a comparison with a corresponding detail of the steel strip 1 which is shown in FIG. 3.

Figure 3:
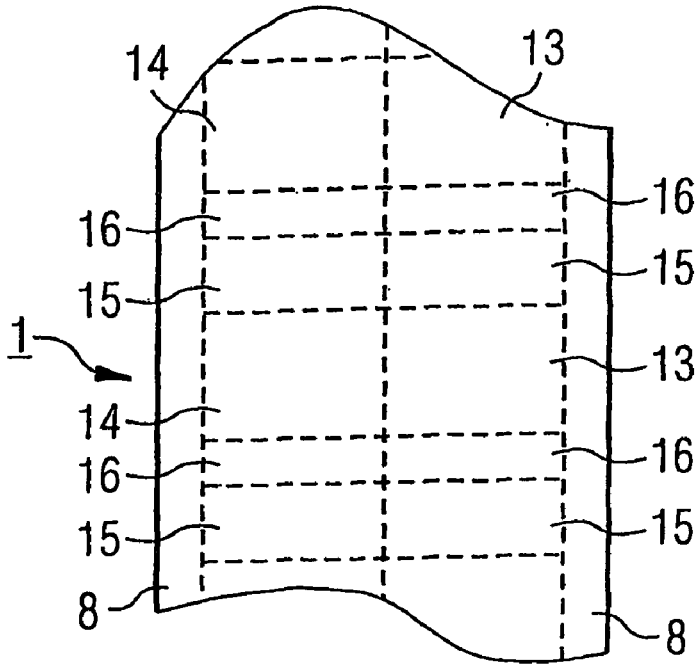
FIG. 3 is a fragmentary, plan view of a strip material corresponding to the spreadsheet shown in FIG. 2.

FIG. 3 diagrammatically shows a detail of a steel strip 1. This steel strip has first product areas 13 and second product areas 14, which are formed by the surface of end products to be manufactured from the steel strip 1. Furthermore, there are third product areas 15, which will belong to the surface of the end product once that end product has been produced. Additionally, intermediate areas 16 are formed, which are located between the product areas 13, 14, 15 but do not contribute to the end product, as well as edge areas 8 which, together with the intermediate areas 16, form scrap steel, which does not contribute to the end product to be manufactured.

Once the automatic surface inspection has been carried out, surface data is available which can be associated with the coordinates on the surface of the steel strip 1. According to the method of the invention for the preprocessing of surface data, the surface data is grouped, in which case a grouping operation has been selected which is matched to the areas 13, 14, 15 of the end product to be manufactured. First groups of surface data are thus formed, which are matched to the first product area 13. This means that the first groups of surface data include only data records which can be physically associated with the coordinates of the first product area 13. Second groups of surface data are formed analogously, which can be associated with the spatial coordinates of the second product area 14, and third groups, which can be physically associated with the third product areas 15. In addition, intermediate groups and edge groups are formed, which can be physically associated with the intermediate areas 16 and the edge areas 8.

In the spreadsheet 9 illustrated in FIG. 2, each group is shown in its own cell. The first group is thus shown in each case in a first cell 17, the second group in a second cell 18, and third group in a third cell 19. The first product area 13 thus corresponds to the first cell 17, the second product area 14 to the second cell 18, and the third product area to the third cells 19. The intermediate areas 16 correspond to intermediate cells 20, and the edge areas 8 correspond to edge cells 21. The spreadsheet 9 is thus subdivided corresponding to the subdivision on the basis of product areas 13, 14, 15 of the steel strip 1.

In this illustration, the cells 17, 18, 19, 20, 21 contain the number of surface anomalies in the respective area 13, 14, 15, 16, 8 of the steel strip 1. The cells 17, 18, 19, 20, 21 in the spreadsheet 9 are colored with a different background, indicating the relevance of the faults in the cells 17, 18, 19, 20, 21 for the allocation of a quality level to the steel strip 1. In this case, a quality level means compliance with specific quality standards which are required for the production of the end product. The relevance for quality-level determination is governed by predeterminable criteria which, as indicated by way of example above, can be stated in the form of a formula in the spreadsheet. Thus, by way of example, despite the relatively large total of thirty-two surface anomalies in the first cell 17, the relevance of these faults for the end product to be produced is low.

This relevance data that is produced makes it possible to easily assign a quality level to the steel strip 1. This assignment can be carried out either automatically or manually by a user. If the quality level of the steel strip 1 does not allow compliance with a quality standard for an end product to be manufactured, the preprocessing of the data advantageously allows the quality level to be determined with respect to a different end product to be manufactured. This can be done on one hand by using other relevance criteria which are matched to the other end product to be manufactured. On the other hand, regrouping is possible by using grouping rules which, for example, are matched to other product areas 13, 14, 15 and, in a corresponding manner, other intermediate areas 16 and edge areas 8. This advantageously allows quality management in which it is possible to choose an end product, which can be manufactured as optimally as possible therefrom, for each strip material. The comparison of a plurality of surface data items from different strip materials makes it simple to find faults in the production of the strip materials, and thus to overcome them more quickly.

Figure 4:
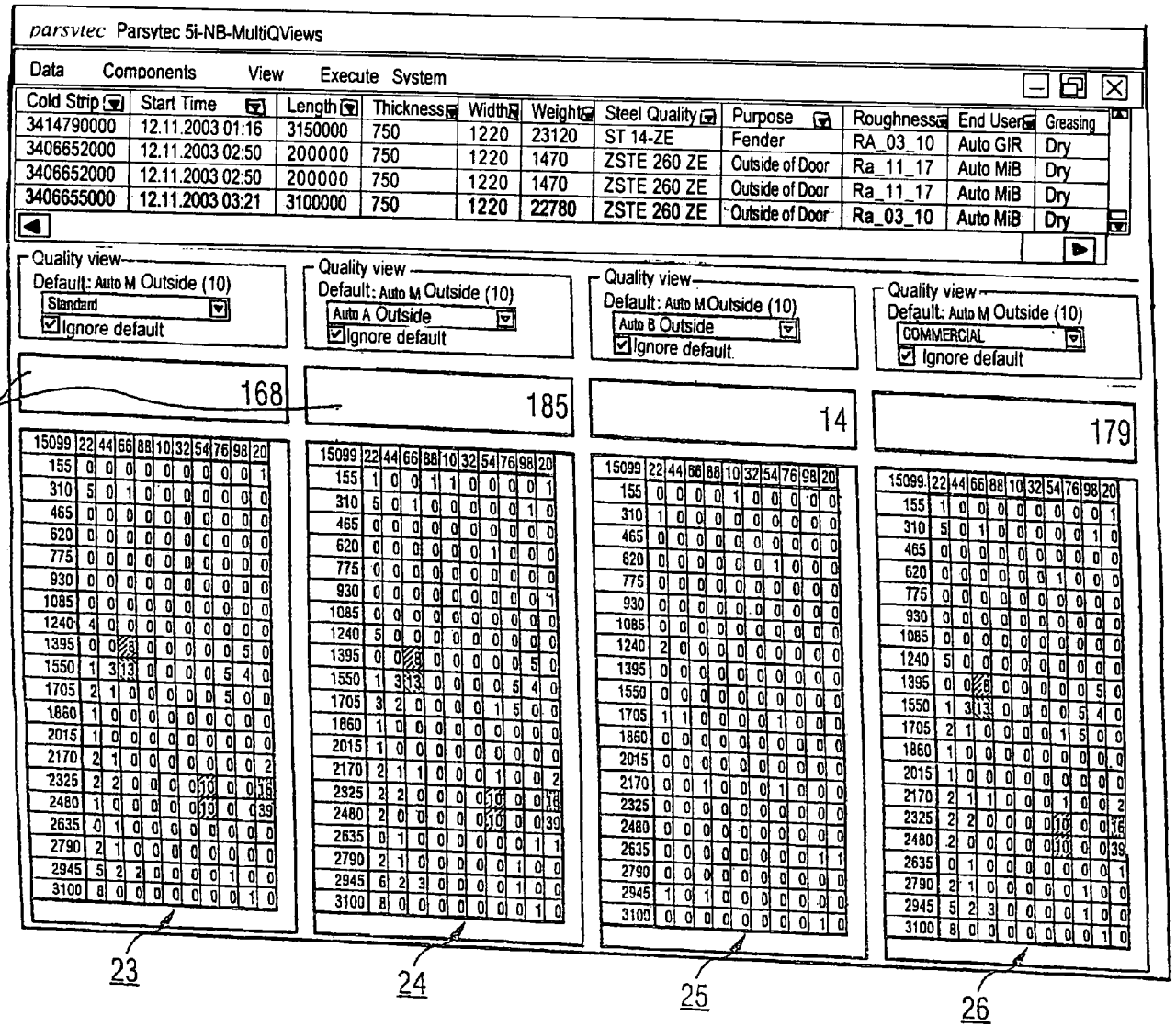
FIG. 4 is a plan view of a first exemplary embodiment of a spreadsheet calculation having a plurality of spreadsheets.

FIG. 4 shows a first exemplary embodiment of a view based on the type of spreadsheet calculation with a first spreadsheet 22, a second spreadsheet 23, a third spreadsheet 24, a fourth spreadsheet 25 and a fifth spreadsheet 26. The spreadsheet 22 contains a list of all of the existing strip materials, in each case listing different parameters of each strip material, such as an identification number, a production start time, the length, width, thickness and the weight of the strip material, in individual cells. Further parameters are the steel quality, as well as the planned purpose, the roughness and the customer for the strip material. Additional parameters can be added easily and quickly in the form of a spreadsheet calculation, by adding rows and/or columns.

The second 23, third 24, fourth 25 and fifth 26 spreadsheet each contain geometric views of the strip material currently selected in the first spreadsheet 22, with the corresponding groupings. Each of the four spreadsheets 23, 24, 25, 26 shows the relevance of the detected surface anomalies for a different quality standard to be complied with, with the overall relevance being combined in each of combination cells 27. On one hand, this allows the number of relevant faults to be read on the basis of the cell content, and on the other hand allows the overall relevance for compliance with the respective quality standard to be read from the coloring of the cell. In the present example in FIG. 4, the use corresponding to the third spreadsheet 24 would be the most critical, while the use corresponding to the second spreadsheet 23 and the fifth spreadsheet 26 would be less critical. This allows the achievable yield to be optimized on the basis of the price to be achieved for the individual purposes.

Figure 5:
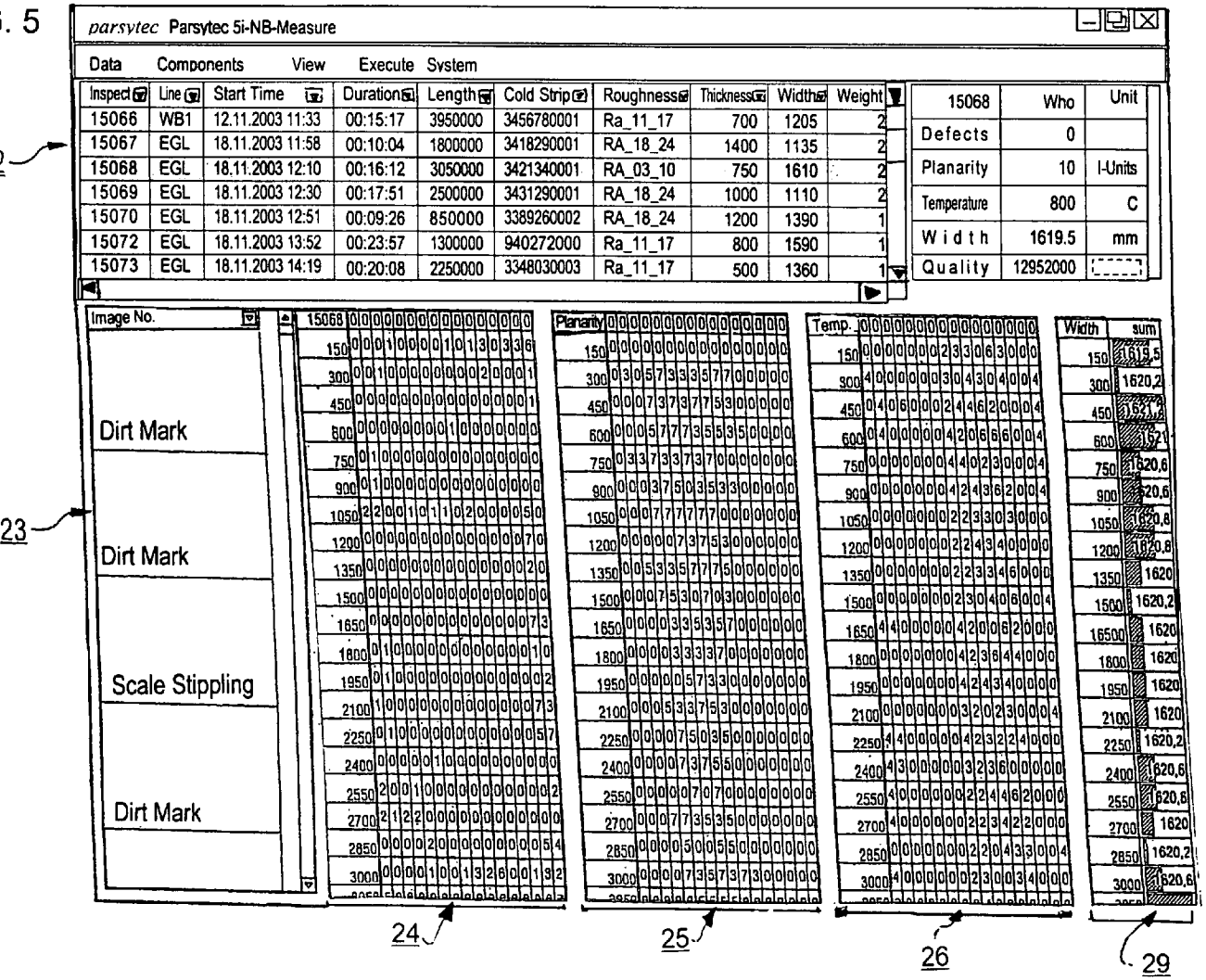
FIG. 5 is a plan view of a second exemplary embodiment of a spreadsheet calculation having a plurality of spreadsheets.

FIG. 5 shows a second exemplary embodiment of a view in the form of a spreadsheet calculation with a first spreadsheet 22, a second spreadsheet 23, a third spreadsheet 24, a fourth spreadsheet 25, a fifth spreadsheet 26, a sixth spreadsheet 28 and a seventh spreadsheet 29. The first spreadsheet 22 contains a list of all of the available strip materials, in a similar manner to that in the first exemplary embodiment, with parameters such as an identification number for the inspection data record, the production line on which the strip material is produced, the manufacturing start time, the time taken for manufacture, the length of the strip material, the cold strip from which the steel strip is produced, the roughness of the material, the thickness, the width and the weight, etc. The third spreadsheet 24, the fourth spreadsheet 25 and the fifth spreadsheet 26 contain illustrations which are matched to the geometric relationships of the strip material. The rows each show data at a specific longitudinal coordinate, that is to say in the movement direction of the strip material, while the columns indicate the transverse coordinate of the strip material. The third spreadsheet 24 shows the number of surface anomalies per group of data records associated with each cell, while the fourth spreadsheet 25 shows the planarity discrepancy for each group from the mean planarity. The fifth spreadsheet 26 shows the discrepancy in the finishing temperature for each group from a mean finishing temperature. The sixth spreadsheet 28 shows the combination of the quality-relevant parameters, specifically the number of defects, that is to say the surface anomalies which would prevent classification in one quality standard, as well as the mean planarity of the strip material, the finishing temperature, the mean width and the quality level resulting therefrom. The seventh spreadsheet 29 shows the discrepancy from the mean width of the strip material, resolved for the longitudinal coordinates of the strip material. The second spreadsheet 23 contains individual illustrations of surface anomalies. The spreadsheets 22, 23, 24, 25, 26, 28, 29 are linked to one another so that, for example, if the computer mouse is clicked on one of the cells in the spreadsheets 24, 25, 26, the corresponding illustrations of the anomalies in this cell in the spreadsheets 24, 25, 26 are indicated in the second spreadsheet 23. A click in a different column of the first spreadsheet 22 leads to the corresponding data for this strip material that has now been selected being displayed in the other spreadsheets 23, 24, 25, 26, 28, 29, etc.

As has been described by way of example herein, any desired spreadsheets can thus be combined with one another as required, with different displays, filtering operations and/or grouping operations. This is done in a simple manner in the form of a spreadsheet calculation, which even substantially untrained users can carry out. The assignment of the quality level is thus reproducible, and is transparent for third parties.

Figure 6:
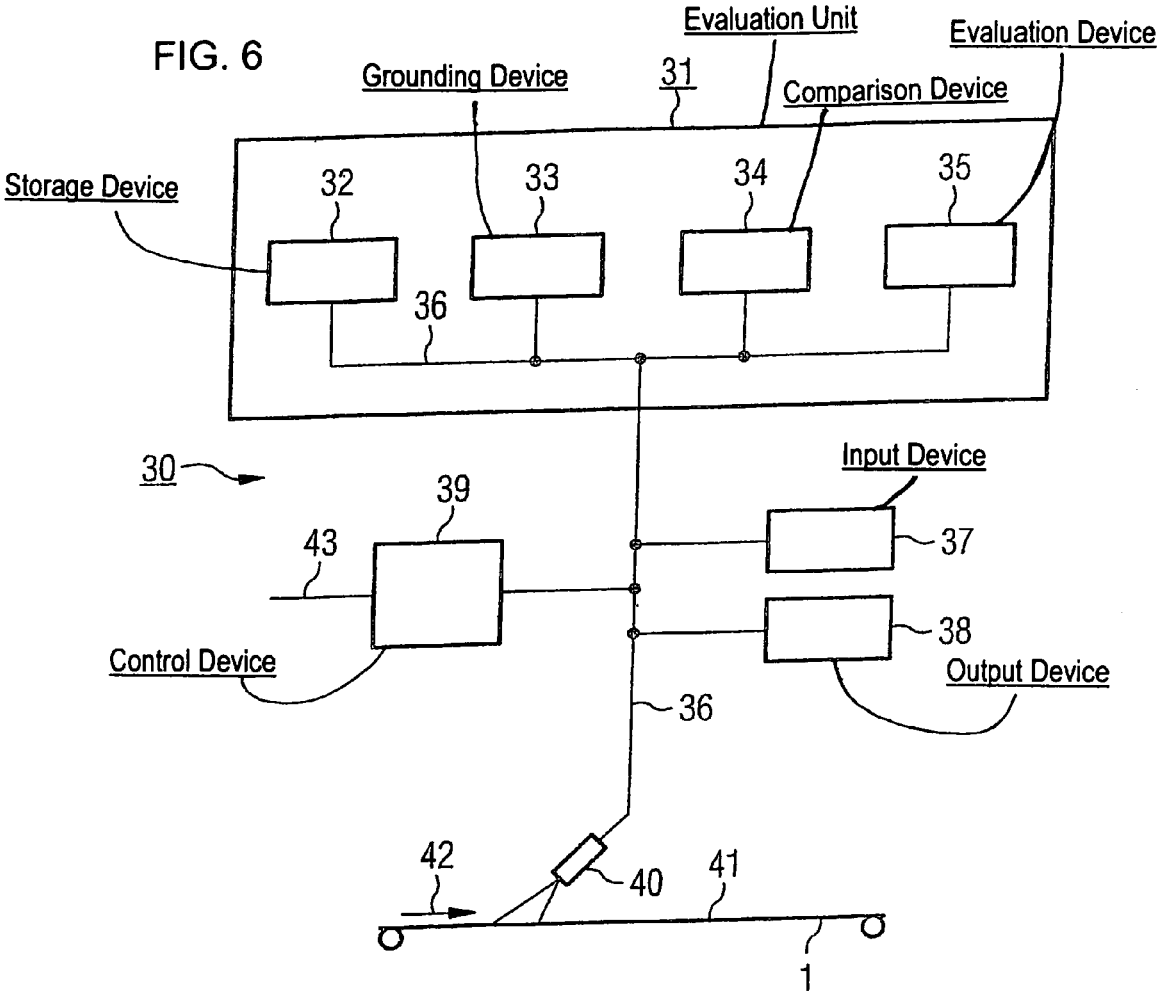
FIG. 6 is a schematic and block diagram of an exemplary embodiment of an apparatus according to the invention.

FIG. 6 shows one exemplary embodiment of an apparatus 30 according to the invention for controlling the processing of strip materials 1, with an evaluation unit 31. The evaluation unit includes at least a storage device 32, a grouping device 33 and a comparison device 34. In addition to further possible components, the evaluation unit 31 in the present example has an evaluation device 35 which, however, is optional. Data links 36 are formed in order to connect the individual components 32, 33, 34, 35. These links can advantageously represent an addressable bus system, so that all of the connected components 32, 33, 34, 35 as well as further connected components can be addressed individually through one common data link 36. The data links may either be in the form of a wire, or may at least partially be wireless.

Data can be stored in the storage device 32, to be precise at least surface data and/or quality standard data which can be associated with an end product that can be manufactured from the strip material 1. The surface data is in the form of data records which can be associated with the strip surface on the basis of coordinates, and in each case include surface data in particular such as surface roughness, planarity, a finishing temperature and/or the thickness of the strip material 1 and, if required, the data relating to at least one surface anomaly that is present. Further data can be stored, according to the invention. The grouping device 33 is used for grouping surface data on the basis of predeterminable grouping rules. The surface data is compared with at least one predeterminable quality standard on the basis of the comparison device 34. The result of the grouping process in the grouping device 33 and of the comparison in the comparison device 34 (the comparison data) can be transmitted through the data link 36 to other components which are connected to them. The result of the comparison as well as the grouped surface data can thus be transmitted to the storage device 32, and can be stored therein.

Furthermore, an input device 37 and an output device 38 are provided, through the use of which commands can be entered and at least the surface data can be output, with at least one spreadsheet being input and output. The input device 37 and the output device 38 are likewise connected to the data link 36, so that it is possible to access the data stored in the storage device 32, as well as the data which has been output from the grouping device 33 and the comparison device 34, for inputting and outputting. A keyboard and/or a computer mouse or the like can advantageously be provided as the input device 37 and, in particular, a monitor can advantageously be provided as the output device 38. The input device 37 can also advantageously be used for inputting and/or definition of the grouping rules and/or of the comparison standards and/or of the quality rules for comparison of the groups with at least one quality standard.

In addition, the apparatus 30 has a control device 39 which initiates a specific process for processing of the strip material 1 in order to manufacture an end product as a function of the comparison data produced by the comparison device 34, or reject the strip material 1, for example as being unusable. Alternatively or additionally, a user action can take place there. In this case, a specific processing process should be understood as meaning, in particular, the supply of the strip material for production of a specific end product. For example, the control device can supply the strip material for production of a first end product (for example a fender) or for production of a second end product (for example an engine compartment hood) as a function of the comparison data produced by the comparison device 34. The supply to a specific processing process can be carried out through the use of an optional control input 43, in which the control commands from the control device 39 are passed to appropriate apparatuses.

The surface data can be stored in the storage device 32, or can be saved there by a data storage medium which, for example, is used as material accompanying the strip material 1. Furthermore, the evaluation unit can optionally be linked directly to a measured-value recorder 40 through the data link 36, according to the invention. The optical measured-value recorder 40, preferably a camera, and particularly a CCD or CMOS camera, advantageously makes it possible to record surface data for a surface 41 of a strip material 1, which may be moving in a movement direction 42. Anomalies can be found by the evaluation device 35. The apparatus shown herein can be implemented, at least in parts, in an integrated circuit and/or a computer. The apparatus shown herein is preferably suitable for carrying out the method according to the invention. Reference is expressly made to the statements made above in particular for carrying out the evaluation process, for assignment of the quality level, for grouping, etc. If the system is used on-line, it is also possible according to the invention to make colored markings on this strip, by way of example, when predetermined contents occur in specific cells, or to carry out such markings of the strip end through the use of colored markings, stampings, perforations or the like, in order to identify the characteristics of the strip. The control device 39 is connected to a marking device 44 for this purpose.

On the basis of the preprocessing of the surface data for a strip material, according to the invention, this data can for the first time be used to make reliable statements even during the production of the strip material, on the basis on one hand of the strip material and on the other hand of the end product to be manufactured therefrom, relating to the achievable quality of the end product, and/or to use the preprocessed surface data in a simple manner both in production planning and in quality management.

I claim:

1. A method for preprocessing data for a strip material, the method comprising the following steps:

providing the data in the form of data records to be associated with a strip surface according to coordinates and to include information about a condition of at least one of the strip or the strip surface or a possibly present anomaly;

grouping and storing at least some of the data records in cells on a basis of predeterminable grouping rules;

geometrically configuring the cells on a visualization medium having a topological similarity to the strip surface;

making contents of the cells available for at least one of further electronic processing or linking to other cells or other data; and permitting the contents of one of the cells to be not one-dimensional but to contain and make available at least one of source data, grouping rules or processing formulae.

2. The method according to claim 1, wherein the strip material is at least one of metal or paper strips.

3. The method according to claim 1, which further comprises storing and making the data available in the form of at least one spreadsheet having a plurality of cells disposed in rows and columns.

4. The method according to claim 1, which further comprises including at least one of material data, color data, values relating to surface roughness, surface planarity, a finishing temperature or thickness values of the strip material, in the data.

5. The method according to claim 1, which further comprises including at least one of at least one anomaly type, an anomaly size or an anomaly severity, in a data record for an anomaly.

6. The method according to claim 1, which further comprises using the grouping rules to carry out at least one of the following grouping operations:

a) combining data records corresponding to at least one of physically adjacent or correlated anomalies;

b) combining data records to be physically associated with predeterminable areas of the strip material;

c) combining data records corresponding to identical anomalies;

d) combining data records including anomalies alone or together with at least one of other anomalies or with other data, allowing an assignment of a quality level in comparison to at least one quality standard; or e) a combination of data records corresponding to surface anomalies with an anomaly severity, and being within a predeterminable value range of the anomaly severity.

7. The method according to claim 6, wherein the other data relates to surface roughness or planarity.

8. The method according to claim 6, wherein the at least one quality standard is that of an end product to be manufactured from the strip material.

9. The method according to claim 6, which further comprises, during a grouping operation based on at least one of operation b) or c), taking areas of the strip material into account which can be assigned to at least one subarea of an end product to be manufactured from the strip material.

10. The method according to claim 6, which further comprises, during a grouping operation based on operation b), imaging a geometric condition of the strip material.

11. The method according to claim 10, which further comprises imaging the geometric condition of the strip material with respect to scrap areas governed by a production process of the strip material.

12. The method according to claim 1, which further comprises matching individual cells of the spreadsheet at least with respect to position, orientation and size, to at least one of a geometric condition of the strip material or at least one of a position, orientation or physical extent of the anomalies or groups on the strip surface.

13. The method according to claim 5, which further comprises matching individual cells with respect to at least one of the following variables:

A) color of a background;

B) color of the cell contents;

C) shading of the cell;

D) font of the cell contents;

E) script emphasis of the cell contents; or

F) script pitch of the cell contents; and using the variables A) to F) to represent a relevance for an assignment of a quality level of an end product to be manufactured from the strip material.

14. The method according to claim 5, which further comprises assigning a quality level relative to predeterminable quality criteria.

15. The method according to claim 14, which further comprises assigning the quality level on an absolute basis.

16. The method according to claim 14, which further comprises carrying out the assignment on a basis of a formula in a spreadsheet calculation.

17. The method according to claim 1, which further comprises representing at least one data record or at least one group at least partially in one cell of a spreadsheet.

18. The method according to claim 1, which further comprises forming a plurality of spreadsheets with different representations of the surface data.

19. The method according to claim 18, which further comprises linking the spreadsheets to one another.

20. The method according to claim 1, which further comprises predetermining which elements of the data in a group or in a data record can be represented in a spreadsheet.

21. The method according to claim 20, which further comprises predetermining a breakdown in which the data from a group or a data record can be represented.

22. The method according to claim 1, which further comprises linking individual cells to representations which the data of the group linked to this cell or of a data record linked to this cell at least partially shows.

23. The method according to claim 22, which further comprises linking the individual cells at least to a graphical representation of a corresponding surface anomaly.

24. The method according to claim 1, which further comprises obtaining at least some of the surface data from signals from at least one measured-value recorder.

25. The method according to claim 24, wherein the at least one measured-value recorder is a camera.

26. The method according to claim 25, wherein the camera is a CCD camera.

27. A method for quality assessment of a surface of moving strip materials, the method comprising the following steps:

preprocessing surface data on a basis of the method according to claim 1; and assigning a quality level to the strip material based on the preprocessed surface data.

28. The method according to claim 27, wherein the strip materials are metal or paper strips.

29. The method according to claim 27, wherein the quality level is relative to one or more predeterminable quality standards.

30. A method for quality management of strip materials, the method comprising the following steps:

assigning a quality level to the strip material by preprocessing surface data on a basis of the method according to claim 1 and assigning a quality level to the strip material based on the preprocessed surface data; and supplying the strip material, on a basis of the assigned quality level, to a processing step requiring a specific quality level.

31. The method according to claim 30, wherein the strip materials are metal or paper strips.

32. A method for quality management of strip materials, the method comprising the following steps:

preprocessing the surface data with the method according to claim 1; and configuring at least one of a production process or a process used for processing the strip material on a basis of the preprocessed surface data, to produce as little waste as possible during manufacture of an end product from the strip material.

33. The method according to claim 32, wherein the strip materials are metal or paper strips.

34. An apparatus for controlling the processing of strip materials, the apparatus comprising:

an evaluation unit including at least:

a) a storage device for storing at least one of surface data to be associated with a strip surface according to coordinates or quality standard data to be associated with an end product to be manufactured;

b) a grouping device for grouping said surface data on a basis of predeterminable grouping rules, with a group including at least one data record of said surface data; and c) a comparison device for comparing groups of said surface data with at least one predeterminable quality standard and supplying comparison data;

data links connected to said evaluation unit;

an input device and an output device, connected to said evaluation unit through said data links, for inputting commands and at least outputting said surface data from said evaluation unit;

a control device connected through said data links at least to said evaluation unit and to at least one of said input device or said output device;

said input device and said output device interacting to display and process said surface data, to input at least one of said grouping rules or comparison rules in a corresponding manner, and to compare said groups with at least one quality standard in the form of at least one spreadsheet; and said control device initiating a specific process for processing the strip material to manufacture an end product or rejecting the strip material, on a basis of at least one of said comparison data supplied by said comparison device or a user input.

35. The apparatus according to claim 34, wherein the strip materials are metal or paper strips.

36. The apparatus according to claim 34, which further comprises a marking device connected to said control device.

37. The apparatus according to claim 36, wherein said marking device colors or perforates a strip material at least one of on a basis of predeterminable criteria or at parts with particular anomalies.

38. An apparatus for controlling the preprocessing of strip materials by carrying out the method according to claim 1, the apparatus comprising:

an evaluation unit including at least:

a) a storage device for storing at least one of a surface data to be associated with a strip surface according to coordinates or quality standard data to be associated with an end product to be manufactured;

b) a grouping device for grouping said surface data on a basis of predeterminable grouping rules, with a group including at least one data record of said surface data; and c) a comparison device for comparing groups of said surface data with at least one predeterminable quality standard and supplying comparison data;

data links connected to said evaluation unit;

an input device and an output, connected to said evaluation unit through said data links, for inputting commands and at least outputting said surface data from said evaluation unit;

a control device connected through said data links at least to said evaluation unit and to at least one of said input device or said output device;

said input device and said output device interacting to display and process said surface data, to input at least one of said grouping rules or comparison rules in a corresponding manner, and to compare said groups with at least one quality standard in the form of at least one spreadsheet; and said control device initiating a specific process for processing the strip material to manufacture an end product or rejecting the strip material, on a basis of at least one of said comparison data supplied by said comparison device or a user input.

39. The apparatus according to claim 34, which further comprises at least one measured-value recorder for recording said surface data, said at least one measured-value recorder being connected to said evaluation unit through said data links and transmitting said surface data to said evaluation unit.

40. The apparatus according to claim 39, wherein said at least one measured-value recorder is a camera.

41. The apparatus according to claim 40, wherein said camera is a CCD or CMOS camera.

42. The apparatus according to claim 39, which further comprises an evaluation device for using said surface data to detect surface anomalies on the surface of the strip material.

* * * * *